US006631596B1

(12) United States Patent
Sorkin

(10) Patent No.: US 6,631,596 B1
(45) **Date of Patent: *Oct. 14, 2003**

(54) CORROSION PROTECTION TUBE FOR USE ON AN ANCHOR OF A POST-TENSION ANCHOR SYSTEM

(76) Inventor: Felix L. Sorkin, 4115 Greenbriar Dr., Stafford, TX (US) 77477

( * ) Notice: Subject to any disclaimer, the term of this patent is extended or adjusted under 35 U.S.C. 154(b) by 116 days.

This patent is subject to a terminal disclaimer.

(21) Appl. No.: 09/687,072

(22) Filed: Oct. 16, 2000

(51) Int. Cl.[7] ..... E04L 5/08

(52) U.S. Cl. ..... 52/223.13; 24/122.6; 403/371; 403/374.1; 52/223.6

(58) Field of Search ..... 52/223.13, 223.14, 52/223.6; 403/282, 315, 326, 329, 371, 373, 374.1, 367, 368; 285/331, 921; 24/122.6, 459, 464

(56) References Cited

U.S. PATENT DOCUMENTS 4,679,827 A * 7/1987 Law ..... 285/158
5,072,558 A 12/1991 Sorkin
5,333,607 A * 8/1994 Kee ..... 128/204.18
5,749,185 A 5/1998 Sorkin
5,770,286 A 6/1998 Sorkin
5,788,398 A 8/1998 Sorkin
5,839,235 A * 11/1998 Sorkin ..... 52/223.13
6,017,165 A * 1/2000 Sorkin ..... 403/374.1
6,027,278 A * 2/2000 Sorkin ..... 403/374.1
6,098,356 A 8/2000 Sorkin
6,234,709 B1 * 5/2001 Sorkin ..... 403/374.1

* cited by examiner

*Primary Examiner*—Carl D. Friedman
*Assistant Examiner*—Yvonne M. Horton
(74) *Attorney, Agent, or Firm*—Harrison & Egbert

(57) ABSTRACT

A post-tension anchor system including an anchor encapsulated with a polymeric material, a corrosion protection tube having a connection portion at one end and a sealing portion on an opposite end thereof, and a tendon having a sheathed portion and an unsheathed portion. The anchor has a trumpet portion with a notch extending outwardly therefrom. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

9 Claims, 3 Drawing Sheets

CORROSION PROTECTION TUBE FOR USE ON AN ANCHOR OF A POST-TENSION ANCHOR SYSTEM

BACKGROUND OF THE INVENTION

1. Field of the Invention

The present invention relates to post-tensioning systems. More particularly, the present invention relates to encapsulated anchor systems which serve to maintain the tendon of the post-tension system in a corrosion resistant condition. More specifically, the present invention relates to an anchor as used in conjunction with a corrosion protection tube for such post-tension anchor systems.

2. Description of Related Art

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

A problem that affects many of the anchorage systems is the inability to effectively prevent liquid intrusion into the area of the unsheathed portion of the tendon. Normally, the unsheathed portion will extend outwardly, for a distance, from the anchor. In normal practice, a liquid-tight tubular member is placed onto an end of the anchor so as to cover the unsheathed portion of the tendon. The tubular member slides onto and over the trumpet portion of the encapsulated anchor so as to be frictionally engaged with the trumpet portion of the anchor. The opposite end of the tubular member will include a seal which establishes a generally liquid-tight connection with the sheathed portion of the tendon.

Unfortunately, various experiments with such systems have indicated that such "frictional engagement" between the liquid-tight tubular member and the trumpet portion of the anchor is inadequate for preventing liquid intrusion to the unsheathed portion of the tendon. In common practice, workers at the construction site will not attach the tubular member to the trumpet portion of the anchor in a suitable manner. As such, liquid will eventually migrate through the connection between the trumpet portion of the anchor and the end of the tubular member. In other circumstances, because of the stresses placed upon the tendon, the tubular member will become disengaged from the end of the trumpet portion of the anchor. In still other circumstances, workers will step on the tubular member during the installation of the anchorages such that the tubular member becomes dislodged from the trumpet portion of the anchor. In all of these circumstances, the "frictional engagement" between the tubular member and the trumpet portion of the anchor provides an inadequate connection.

The present inventor has developed corrosion protection tubes for more efficient engagement with post-tension anchors. U.S. Pat. No. 5,839,235, issued on Nov. 24, 1998, to the present inventor, teaches a corrosion protection tube with a snap-fit engagement for a post-tension anchor system. The snap-fit engagement creates a tight connection between the trumpet portion of the anchor and the tube. Although these tubes perform better than the "frictional engagement" used in prior art, experience has shown that the connection of the anchor to the tube still requires the use of a separate collar to enclose the point of connection between the anchor and tube. The snap-fit arrangement of the corrosion protection tube of the prior art does not provide an adequate connection to prevent liquid intrusion. Additionally, it can be somewhat difficult to insert the arrowhead-shaped tube into the interior of the trumpet portion of the anchor. Inspection can also be difficult.

U.S. Pat. No. 5,788,398, issued on Aug. 4, 1998 to the present inventor, describes another type of connector seal for an anchor and a corrosion protection tube of a post-tension system. This connector is formed of an elastomeric material and a seal formed interior of the connector. The body of the connector has a first receptacle formed on one end thereon for attachment to the end of the anchor. The body has a second receptacle formed at an opposite end thereof for attachment to the end of the corrosion protection tube. The seal is positioned between the first receptacle and the second receptacle so as to form a liquid-tight seal with a surface of the tendon passing therethrough. The first receptacle is an orifice that has a diameter suitable for liquid-tight engagement with the end of the anchor. The second receptacle is an opening formed at an opposite end of the body having a diameter suitable for liquid-tight engagement with the surface of the corrosion protection tube. The seal is a membrane with extends transverse to the longitudinal axis of the body. The membrane was a central area with a diameter less than an outer diameter of the tendon.

U.S. Pat. No. 5,770,286, issued on Jun. 23, 1998 to the present inventor, describes a seal having a cap with a tubular body and a surface extending across the tubular body. A corrosion resistant material is contained within the interior area of the cap. The surface closes an end of the tubular body. The surface has a frangible area formed thereon. The surface extends transverse to the longitudinal axis of the tubular body at one end of the tubular body. The frangible area has a thickness less than a thickness of a non-frangible remainder of the surface. The cap is formed of a polymeric material. The corrosion-resistant material is contained within the cap of a suitable volume so as to fill a void in the tubular member between the inner diameter of the tubular member and the outer diameter of a tendon extending therethrough.

U.S. Pat. No. 5,072,588, issued on Dec. 17, 1991 to the present inventor, teaches a tendon tensioning anchor of the prior art in which a corrosion protection tube is affixed to the trumpet portion of the anchor in frictional engagement therewith. A seal is fastened to the other end of the tubing so as to create a liquid-tight seal with a tendon passing therethrough. The seal is fitted into the end of the tubing opposite the anchor and has a surface extending inwardly so as to reside in surface-to-surface contact with the sheathing of the tendon.

It is an object of the present invention to provide a corrosion protection tube for a post-tension anchorage system that provides a positive connection between the anchor at its trumpet portion and the corrosion protection tube.

It is another object of the present invention to provide a corrosion protection tube which eliminates liquid intrusion at the connection between the anchor and the corrosion protection tube.

It is a further object of the present invention to provide a corrosion protection tube which will remain connected to the trumpet portion of the anchor as various forces are placed upon the corrosion protection tube.

It is still another object of the present invention to provide an anchor which does not require the use of a collar for sealing the connection between the anchor and the corrosion protection tube.

It is still a further object of the present invention to provide a corrosion protection tube and anchor which are easy to install, easy to manufacture, and relatively inexpensive.

These and other objects and advantages of the present invention will become apparent from a reading of the attached specification and appended claims.

BRIEF SUMMARY OF THE INVENTION

The present invention is a post-tension anchor system, which includes an anchor encapsulated with a polymeric material, a corrosion protection tube having a connection portion at one end and a sealing portion on an opposite end thereof, and a tendon having a sheathed portion and an unsheathed portion. The anchor has a trumpet portion extending outwardly therefrom, and the trumpet portion has a notch. The connection portion includes an inwardly extending surface for engagement with the notch of the trumpet portion. The sealing portion is in liquid-tight engagement with the sheathed portion of the tendon. The unsheathed portion of the tendon extends through the corrosion protection tube and the trumpet portion so as to engage the tubular section of the anchor for tensioning the tendon in concrete.

The trumpet portion has a notch extending therearound, which allows for snap-fit engagement with the connection portion of the corrosion protection tube. The trumpet portion includes a tubular body with an outwardly extending surface at an end opposite the anchor, and the notch is positioned between the anchor and the surface. The connection portion of the corrosion protection tube has an inwardly extending surface with an inner diameter smaller than the wide diameter of the outwardly extending surface of the trumpet portion. Alternatively, the connection portion may additionally include an inner sleeve so as to define an annular slot with the inwardly extending surface. The inner sleeve extends into the interior of the trumpet portion.

DETAILED DESCRIPTION OF THE INVENTION

Figure 1:
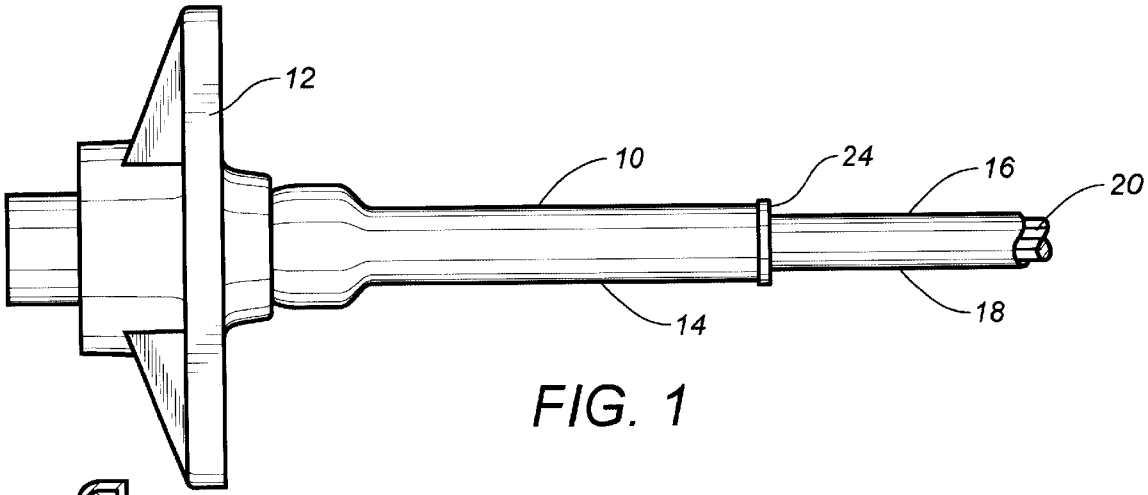
FIG. 1 is a plan view showing the post-tension system of the present invention.

Referring to FIG. 1, there is shown the post-tension anchor system 10 employing the anchor 12, the corrosion protection tube 14 and tendon 16 of the present invention. The tendon 16 is illustrated so as to show a sheathed portion 18 and an unsheathed portion 20. In normal use, however, the sheathed portion 18 will extend over this unsheathed portion 20 at this position on the tendon 16.

Referring to FIG. 1, it can be seen that an end of the corrosion protection tube 14 covers the trumpet portion 22 (not shown) of the anchor 12. The corrosion protection tube 14 and anchor 12 are formed of a liquid-impermeable polymeric material. The corrosion protection tube 14 also includes a seal 24 at the end opposite the anchor 12. The seal 24 is made of elastomeric material having an interior surface which securely engages an outwardly extending edge of the corrosion protection tube 14 and a contact portion extending into the interior of the corrosion protection tube 14. As such, the contact portion frictionally engages the sheathed portion 18 of the tendon 16 extending therethrough. An opening allows the tendon 16 having an unsheathed portion within the corrosion protection tube 14 (not shown) to extend through the interior of the corrosion protection tube 14 towards the anchor. Thus, the seal 24 serves to form a liquid-tight seal between the sheathed portion 18 of the tendon 16 and the corrosion protection tube 14 so as to protect the unsheathed portion within the corrosion protection tube 14.

Figure 2:
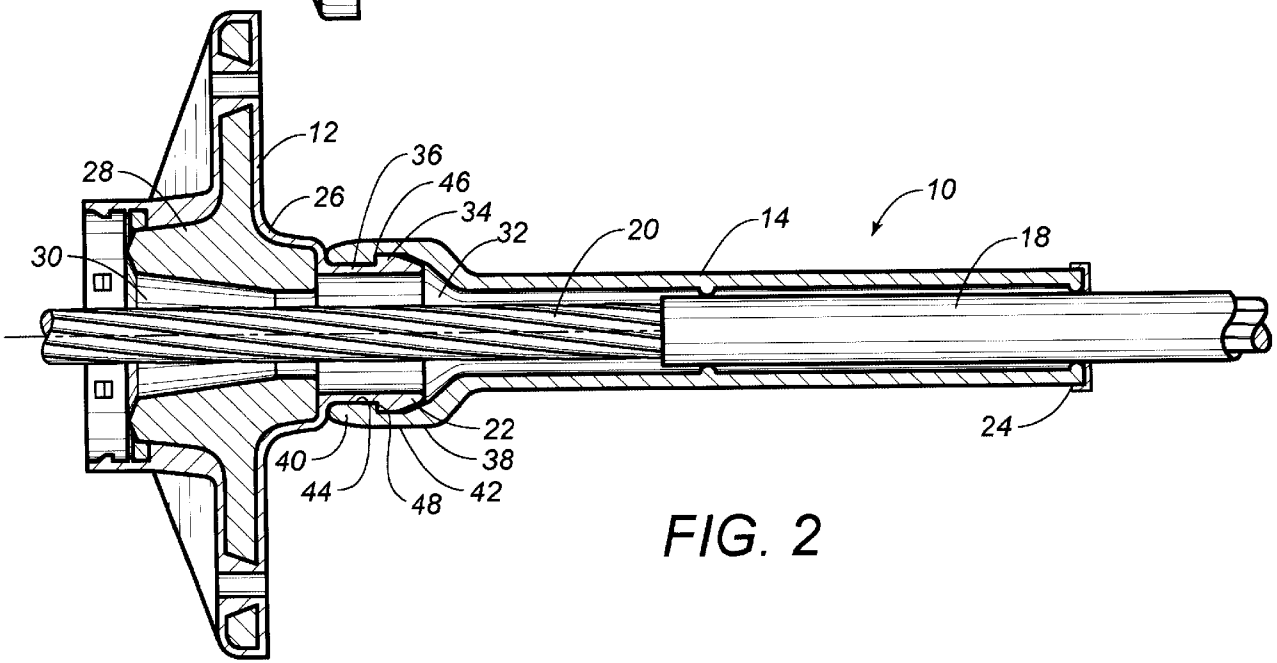
FIG. 2 is a side cross-sectional side view of the post-tension system of the present invention.

FIG. 2 shows the manner in which the post-tension system 10 is assembled. In particular, in FIG. 2, it can be seen that the anchor 12 includes a polymeric encapsulation 26 which generally surrounds the steel anchor 28. The steel anchor 28 will have an interior area 30 which receives the unsheathed portion 20 of the tendon 16. Interior area 30 is tapered so as to receive wedges in interference fit relationship with the unsheathed portion of tendon 16. The polymeric encapsulation 26 forms the trumpet portion 22 alongside the steel anchor 28, and the trumpet portion 22 extends outwardly perpendicular to the steel anchor 28 and in axially longitudinal alignment with interior area 30. As can be seen, the unsheathed portion 20 of the tendon 16 will extend through the interior of the corrosion protection tube 14 and the trumpet portion 22. The sheathed portion 18 of the tendon 16 will extend into the interior of the corrosion protection tube 14. Seal 24 is formed at an end of the corrosion protection tube 14 so as to establish a liquid-tight seal between the exterior surface of the sheathed portion 18 of the tendon 16 and the corrosion protection tube 14. Suitable corrosion-resistant materials, such as grease, can be inserted, if necessary, into the interior 32 of the corrosion protection tube 14 and the trumpet portion 22 so as to resist the intrusion of water and oxygen to the unsheathed portion 20 of the tendon 16.

In FIG. 2, it can be seen that the trumpet portion 22 has an arrowhead-shaped (frustoconical) surface 34 extending outwardly from an end of the tubular body 36 of the trumpet portion 22 opposite anchor 12. The corrosion protection tube 14 has a connection portion 38 which covers the trumpet portion 22. It can be seen that the surface 34 is in snap-fit engagement with an inwardly extending surface 40 of the connection portion 38. The connection portion 38 has a surface 40 extending inwardly of the exterior surface 42 of the connection portion 38. The surface 40 is an annular surface which is formed on the end of the connection portion 38 so as to fit within a notch 44 formed between arrowhead-shaped surface 34 and the steel anchor 28. The shoulder 46 formed on the arrowhead-shaped surface 34 will be in abutment with the shoulder 48 formed at the end of the inwardly extending surface 40. This relationship will resist axial sliding of the corrosion protection tube 14 off the trumpet portion 22.

The connection portion 38 will cover the trumpet portion 22. The connection portion 38 has a wider diameter than the trumpet portion 22. This connection portion 38 facilitates the installation of the corrosion protection tube 14 around the trumpet portion 22. In normal practice, the trumpet portion 22 can be inserted into the opening at the end of the connection portion 38 of the corrosion protection tube 14. The corrosion protection tube 14 fits over the exterior of the trumpet portion 22 when the surface 40 fits into the notch 44. When the positive snap-fit engagement is achieved, the anchor 12 will reside in liquid-tight engagement with the corrosion protection tube 14. The snap-fit engagement of the anchor 12 and the corrosion protection tube 14 dispenses with the need for a sealing collar at the anchor/tube junction.

It is important to note that the anchor and corrosion protection tube of the present invention must be manufactured by injection molding techniques. In prior art practice, the corrosion protection tube 14 was formed by simple extrusion and cutting. This is a relatively simple process that can be carried out in an easy and expeditious manner. However, with the formation of the connection portion 38, along with the formation of the surface 40, it is necessary that the corrosion protection tube 14 be formed by injection molding. Although the anchor 12 and corrosion protection tube 14 of the present invention require a more expensive process to produce, it is felt that the need for complete corrosion resistance in the post-tension anchor system justifies the extra cost.

Figure 3:
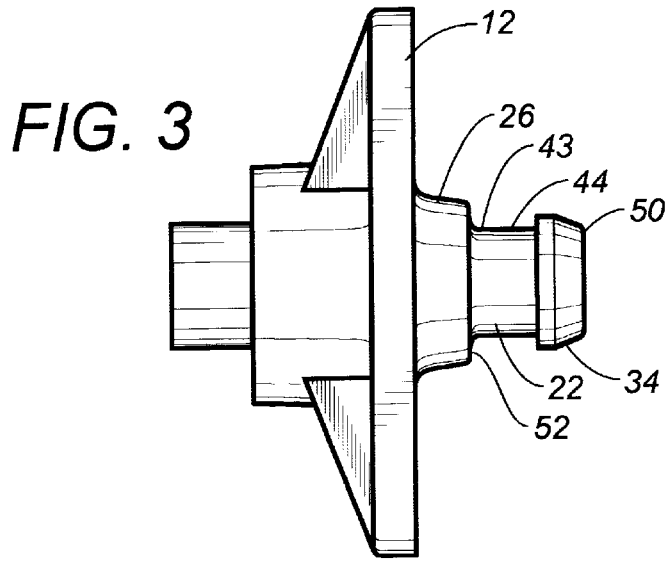
FIG. 3 is an isolated side view of the corrosion protection anchor as used in the system of the present invention.

FIG. 3 shows the anchor 12 as isolated from the corrosion protection tube 14. As can be seen in FIG. 3, the anchor 12 has the tubular body 36 with its arrowhead-shaped (frustoconical) surface 34. The surface 34 is tapered so as to have a narrow diameter at the end 50 of trumpet portion 22 and a wide diameter inwardly thereof. Notch 44 is formed between the wide diameter of surface 34 and the end 52 of the encapsulation 26.

Figure 4:
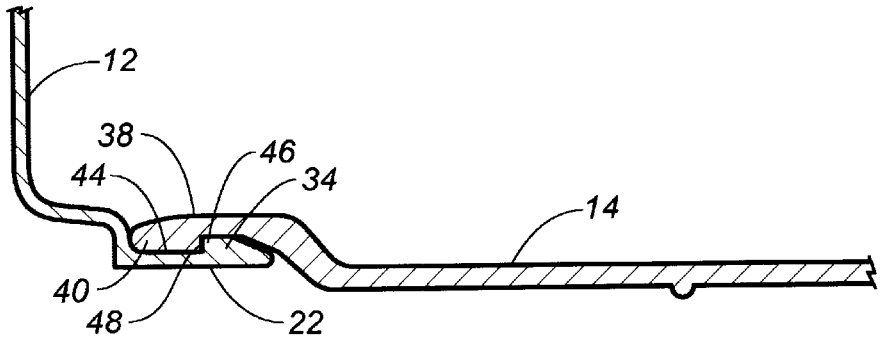
FIG. 4 is a detailed isolated view showing the manner of connection between the corrosion protection anchor and the corrosion protection tube.

FIG. 4 is an isolated view showing the manner in which the notch 44 of the anchor 12 engages the inwardly extending surface 40 of the connection portion 38. As can be seen in FIG. 4, the connection portion 38 of the corrosion protection tube 14 surrounds the exterior of the trumpet portion 22. When the trumpet portion 22 has been inserted a proper distance into the corrosion protection tube 14, the outwardly extending surface 34 will "snap-fit" into the connection portion 38 when shoulder 46 moves past shoulder 48. The inwardly extending surface 40 has a shape which matches the shape of the notch 44.

Figure 5:
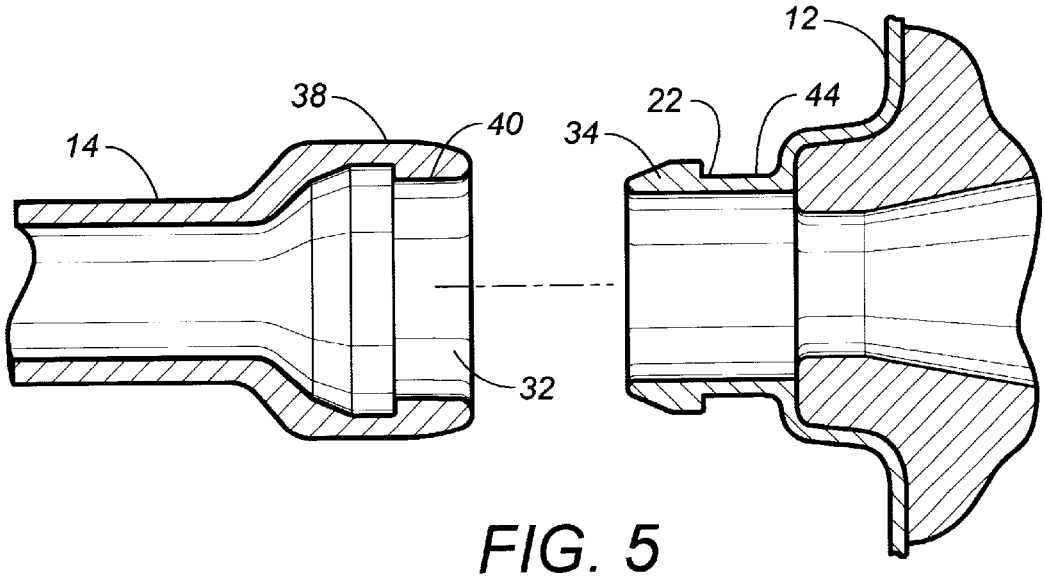
FIG. 5 is an exploded cross-sectional illustration of the simplest form of the present invention.

FIG. 5 shows an exploded sectional view of a simple form of the present invention. In FIG. 5, it can be seen that a corrosion protection tube 14 has connection portion 38 formed at the end of the corrosion protection tube 14. Surface 40 will extend inwardly of the widened connection portion 44. The corrosion protection tube 14 has a tendon-receiving interior 32.

The trumpet portion 22 includes outwardly extending surface 34 at the end 50. The surface 34 will mate with the interior 32 of the connection portion 44 until inwardly extending surface 40 snap-fits into the notch 44. As such, a positive snap-fit engagement is achieved between the corrosion protection tube 14 and the trumpet portion 22 of the anchor 12.

Figure 6:
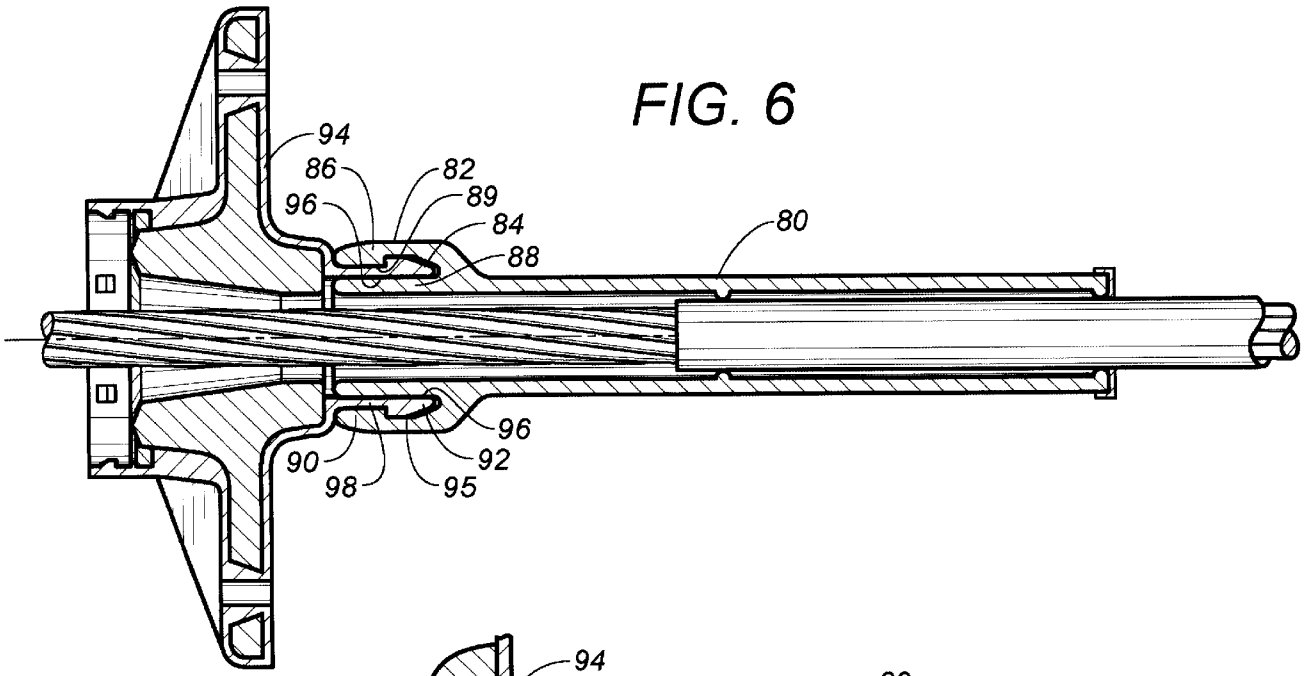
FIG. 6 is a side cross-sectional side view of an alternative embodiment of the present invention.

FIG. 6 shows an alternative embodiment of the present invention. In FIG. 6, it can be seen that the corrosion protection tube 80 has a connection portion 82 with an annular slot 84. The annular slot 84 is formed at the widened connection portion 82 and has an outer sleeve 86 and an inner sleeve 88. The outer sleeve 86 has a surface 89 inwardly extended so as to be in snap-fit engagement with the notch 90 formed by the outwardly extending surface 95 of the trumpet portion 92. The inner sleeve 88 frictionally engages the interior surface 96 of the trumpet portion 92 of the anchor 94. The inner sleeve 88 extends past the opposite side of the notch 90 and through the tubular body 98 of the trumpet portion 92. The connection portion 82 covers the trumpet portion 92 with the exterior sleeve 86 of the annular slot 84 as in the previous embodiment. This alternative embodiment also includes the inner sleeve 88 of the annular slot 84 which provides additional protection from liquid intrusion. The inner sleeve 88 also insures proper alignment of the corrosion protection anchor and tube during installation.

Figure 7:
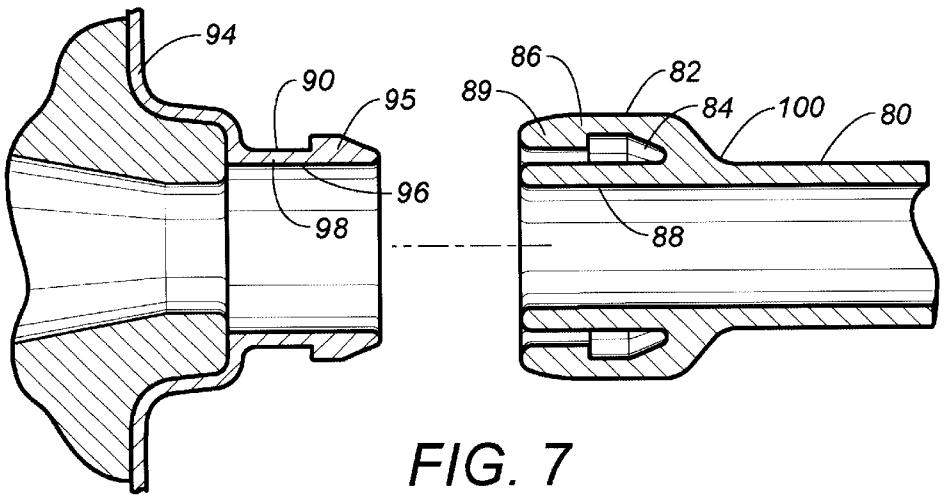
FIG. 7 is an exploded cross-sectional illustration of the alternative embodiment of the present invention.

FIG. 7 shows an exploded sectional view of this alternative embodiment of the present invention. In FIG. 7, it can be seen that a corrosion protection tube 80 has a connection portion 82 formed at an end 100 of the corrosion protection tube 80. The connection portion 82 comprises an annular slot 84 with an outer sleeve 86 and an inner sleeve 88. The outer sleeve 86 has an inwardly extending surface 89 for snap-fit engagement with the notch 90 of the anchor 94. The inner sleeve 88 frictionally engages the inner surface 96 of the trumpet portion 92 of the anchor 94. The trumpet portion 92 includes an outwardly extending surface 95 at the end of the tubular body 98. The notch 90 extends into the annular slot 84 of the connection portion 82 so that the surface 89 snap fits with the notch 90. The interior surface 96 of the trumpet portion 92 frictionally engages the inner sleeve 88. As such, a positive snap-fit engagement and liquid tight seal is achieved between the anchor 94 and corrosion protection tube 80.

The present invention achieves significant advantages over the prior friction-type of engagement systems. First, and foremost, the corrosion protection tube of the present invention establishes a "positive connection" between the anchor and the tube. This "snap-fit" engagement assures that positive liquid-tight contact is established between the tube and the anchor. The form of connection is resistive of all forces which would cause the tube to become dislodged from the tapered portion of the anchor.

The present invention also achieves significant advantages over the prior snap-fit engagement systems. First, the notch of the corrosion protection anchor eliminates the need for a collar. The corrosion protection tube encapsulates the trumpet portion of the corrosion protection anchor; thus the corrosion protection anchor and corrosion protection tube junction is not exposed to liquid intrusion. Second, the snap-fit engagement of the notch and protrusion establishes a stable connection without the tapered surfaces of previous snap-fit systems. The stable connection increases the strength of the corrosion protection anchor so that the corrosion protection tube cannot be twisted off, bent or pulled axially off the trumpet portion. Third, the inner sleeve of the annular slot aligns the corrosion protection tube and the corrosion protection anchor so as to prevent pinching or bending of the tendon. The slot insures that the corrosion protection tube will be installed on the corrosion protection anchor in the proper coaxial alignment.

The foregoing disclosure and description of the invention is illustrative and explanatory thereof Various changes in the details of the illustrated construction may be made within the scope of the appended claims without departing from the true spirit of the invention. The present invention should only be limited by the following claims and their legal equivalents.

I claim:

1. A post-tension anchor system comprising:

an anchor encapsulated with a polymeric material, said anchor having a trumpet portion extending outwardly therefrom, said trumpet portion having a notch formed into an exterior surface thereof, said trumpet portion of said anchor comprising a tubular body with an outwardly extending surface integrally formed therewith at an end opposite said anchor, said notch formed between said anchor and said outwardly extending surface, said outwardly extending surface having an arrowhead shape with a narrow exterior diameter at said end opposite said anchor and a wide exterior diameter adjacent said notch;

a tube having a connection portion at one end and a sealing portion at an opposite end thereof, said connection portion having an interior surface at one end thereof engaged within said notch of said trumpet portion, said connection portion having a shoulder extending radially inwardly thereof and juxtaposed against said wide exterior diameter of said tubular body, said tube having an uninterrupted constant exterior diameter extending from said connection portion to said sealing portion; and a tendon having a sheathed portion and an unsheathed portion, said unsheathed portion affixed within said anchor and extending through said trumpet portion and through a portion of an interior of said tube, said sealing portion of said tube being in liquid-tight engagement with said sheathed portion of said tendon.

2. The post-tension anchor system of claim 1, said interior surface of said connection portion defining an inner diameter of said tube, said inner diameter being smaller than said wide diameter of said outwardly extending surface.

3. The post-tension anchor system of claim 1, said trumpet portion having a shoulder extending radially outwardly therefrom at said wide exterior diameter, said shoulder of said trumpet portion being juxtaposed against said shoulder of said connection portion.

4. The post-tension anchor system of claim 1, said tube being formed entirely of a polymeric material.

5. A corrosion protection apparatus for use with a tendon of a post-tension anchor system comprising:

an anchor having a polymeric encapsulation, said polymeric encapsulation forming a trumpet portion extending outwardly of said anchor, said trumpet portion having a notch formed into an exterior surface thereof, said trumpet portion having a shoulder integral with said polymeric encapsulation and extending radially outwardly therefrom; and a tube having a connection portion at one end thereof, said connection portion having an interior surface received within said notch of said trumpet portion, said connection portion having a shoulder extending radially inwardly therefrom, said shoulder of said trumpet portion being juxtaposed against said shoulder of said connection portion, said tube having an uninterrupted constant exterior diameter extending outwardly from said connection portion, said trumpet portion of said anchor comprising a tubular body with an outwardly extending surface at an end opposite said anchor, said notch formed between said anchor and said outwardly extending surface.

6. The apparatus of claim 5, said outwardly extending surface having an arrowhead shape with a narrow diameter at said end opposite said anchor and a wide diameter adjacent said notch.

7. The apparatus of claim 6, said interior surface of said connection portion defining an inner diameter of said tube, said inner diameter being smaller than said wide diameter of said outwardly extending surface.

8. A corrosion protection apparatus for use with a tendon of a post-tension anchor system comprising:

an anchor having a polymeric encapsulation, said polymeric encapsulation forming a trumpet portion extending outwardly of said anchor, said trumpet portion having a notch formed into an exterior surface thereof, said trumpet portion having a shoulder integral with said polymeric encapsulation and extending radially outwardly therefrom; and a tube having a connection portion at one end thereof, said connection portion having an interior surface received within said notch of said trumpet portion, said connection portion having a shoulder extending radially inwardly therefrom, said shoulder of said trumpet portion being juxtaposed against said shoulder of said connection portion, said tube having an uninterrupted constant exterior diameter extending outwardly from said connection portion, a tube having a sealing means at an opposite end thereof, said sealing means for forming a liquid-tight seal with an exterior surface of an tendon extending therethrough.

9. A corrosion protection apparatus for use with a tendon of a post-tension anchor system comprising:

an anchor having a polymeric encapsulation, said polymeric encapsulation forming a trumpet portion extending outwardly of said anchor, said trumpet portion having a notch formed into an exterior surface thereof, said trumpet portion having a shoulder integral with said polymeric encapsulation and extending radially outwardly therefrom; and a tube having a connection portion at one end thereof, said connection portion having an interior surface received within said notch of said trumpet portion, said connection portion having a shoulder extending radially inwardly therefrom, said shoulder of said trumpet portion being juxtaposed against said shoulder of said connection portion, said tube having an uninterrupted constant exterior diameter extending outwardly from said connection portion, said tube being formed entirely of a polymeric material.

* * * * *